US012359367B1

(12) United States Patent
Liu et al.

(10) Patent No.: US 12,359,367 B1
(45) Date of Patent: Jul. 15, 2025

(54) STORAGE BASKET STRUCTURE AND LAUNDRY BASKET

(71) Applicant: Shenzhen Yi Hong Holding Group Co., Ltd., Guangdong (CN)

(72) Inventors: Wei Liu, Guangdong (CN); Xiao Zhang, Guangdong (CN)

(73) Assignee: Shenzhen Yi Hong Holding Group Co., Ltd., Shenzhen (CN)

( * ) Notice: Subject to any disclaimer, the term of this patent is extended or adjusted under 35 U.S.C. 154(b) by 0 days.

(21) Appl. No.: 18/959,530

(22) Filed: Nov. 25, 2024

(30) Foreign Application Priority Data

Oct. 29, 2024 (CN) ..... 202422617394.7

(51) Int. Cl.
*D06F 95/00* (2006.01)

(52) U.S. Cl.
CPC ..... *D06F 95/002* (2013.01); *D06F 95/004* (2013.01)

(58) Field of Classification Search
CPC ..... D06F 95/002; D06F 95/004; B65B 67/12; B65B 67/1205; B65B 67/1238; B65B 2067/1261; B65F 1/06; B65F 1/1415
See application file for complete search history.

(56) References Cited

U.S. PATENT DOCUMENTS 130,051 A * 7/1872 Hollidge ..... B65B 67/12 248/97
2,451,829 A * 10/1948 Hightower ..... B65B 67/12 248/100
3,614,041 A * 10/1971 Koger ..... B65B 67/12 248/101
4,157,801 A * 6/1979 Elmer ..... B65B 67/12 248/101
4,202,521 A * 5/1980 Harding ..... B65B 67/1205 248/98
4,354,543 A * 10/1982 Bogner ..... B65B 67/12 220/283
4,643,380 A * 2/1987 Copeland ..... B65F 1/00 141/390
4,749,158 A * 6/1988 Buckley ..... F16M 11/041 D34/24
4,759,518 A * 7/1988 Yardas ..... B65B 67/12 248/97
4,783,031 A * 11/1988 Ebentheuer ..... B65B 67/1205 312/258
4,822,178 A * 4/1989 Taylor ..... B65D 33/24 383/33
4,842,228 A * 6/1989 Kasper ..... B65F 1/1415 220/908
4,921,196 A * 5/1990 Rudko ..... B65B 67/12 220/495.11

(Continued)

*Primary Examiner* — William L Miller

(57) ABSTRACT

The present application provides a storage basket structure and a laundry basket. The storage basket structure includes support rods, a top plate, a base and a fabric sleeve. The support rods are lifted by an adjusting device, so as to adjust a distance between the top plate and the base. Since a first end opening and a second end opening of the fabric sleeve are connected to the top plate and the base respectively, the fabric sleeve can be better tightened by increasing the distance between the top plate and the base, thereby achieving a better appearance, presenting a premium feel to users and bringing good user experience.

15 Claims, 12 Drawing Sheets

(56) References Cited

U.S. PATENT DOCUMENTS 4,989,749 A * 2/1991 Choi ..... B65F 1/06 D34/1
5,048,712 A * 9/1991 Wolters ..... B65F 1/163 220/908
RE33,842 E * 3/1992 Ebentheuer ..... B65B 67/1233 312/258
5,263,672 A * 11/1993 He ..... B65B 67/1205 248/97
5,419,453 A * 5/1995 Lochridge ..... B65F 1/06 220/908
5,474,196 A * 12/1995 Fausel ..... D06F 95/002 312/211
5,544,781 A * 8/1996 Mattesky ..... D06F 95/002 220/9.4
5,560,508 A * 10/1996 Hsu ..... D06F 95/002 220/4.31
5,564,660 A * 10/1996 Gyor ..... B65B 67/12 403/241
5,620,108 A * 4/1997 Hsu ..... D06F 95/002 220/4.28
5,659,247 A * 8/1997 Clements ..... A61B 50/30 324/202
5,671,858 A * 9/1997 Hsu ..... B65D 11/18 220/9.4
5,678,717 A * 10/1997 Hsu ..... D06F 95/002 220/4.31
6,237,878 B1 * 5/2001 Nelson ..... B65B 67/1227 248/97
6,382,573 B1 * 5/2002 Cepeda ..... B65B 67/1205 248/150
6,446,919 B1 * 9/2002 Tsui ..... B65F 1/1415 248/97
6,676,092 B2 * 1/2004 Tsai ..... B65F 1/1415 248/173
6,691,879 B1 * 2/2004 Alvarez ..... B62B 3/02 211/85.24
7,284,732 B1 * 10/2007 Lopa ..... B65F 1/1415 248/101
8,100,280 B1 * 1/2012 Hernandez ..... D06F 95/002 220/9.4
9,902,518 B1 * 2/2018 Richardson ..... B65B 67/1205
10,351,155 B1 * 7/2019 Thuma ..... B62B 3/02
10,822,009 B2 * 11/2020 Shimizu ..... B62B 3/002
12,091,813 B1 * 9/2024 Wilson ..... D06F 95/002
2003/0178536 A1 * 9/2003 Tsai ..... B65F 1/1415 248/97
2006/0157358 A1 * 7/2006 Heidel ..... D06F 95/002 206/278
2006/0196879 A1 * 9/2006 Chochinov ..... B65F 1/1615 220/665
2007/0125778 A1 * 6/2007 Uffner ..... B65F 1/1615 220/4.28
2012/0001036 A1 * 1/2012 Santiago ..... B65B 67/1233 248/101
2012/0308165 A1 * 12/2012 Poldervaart ..... D06F 95/002 383/102
2012/0325984 A1 * 12/2012 Moynihan ..... B65F 1/1415 248/97
2014/0008360 A1 * 1/2014 Philip ..... D06F 95/002 220/9.4
2017/0107054 A1 * 4/2017 Lupo ..... B65B 67/1205
2019/0092510 A1 * 3/2019 Ribbe ..... B65B 67/1238
2019/0210767 A1 * 7/2019 Ainsworth ..... B65D 81/3813
2020/0308758 A1 * 10/2020 Shimizu ..... B62B 3/025
2021/0362945 A1 * 11/2021 Chang ..... B65F 1/1607
2022/0127075 A1 * 4/2022 Chang ..... B65F 1/1415
2024/0246756 A1 * 7/2024 Toomey ..... B65F 1/1415

* cited by examiner

STORAGE BASKET STRUCTURE AND LAUNDRY BASKET

CROSS REFERENCE TO RELATED APPLICATIONS

The present application claims the benefit of Chinese Patent Application No. 2024226173947 filed on Oct. 29, 2024, the contents of which are incorporated herein by reference in their entirety.

TECHNICAL FIELD

The present invention belongs to the technical field of storage products, and in particular, to a storage basket structure and a laundry basket.

BACKGROUND

A storage basket structure is often used to store articles in daily life. For example, users often place dirty clothes that need to be changed and washed into the storage basket structure where the dirty clothes are stored in a centralized manner, and then take the dirty clothes for cleaning, or store some messy appliances, toys, and the like therein in a centralized manner to save space.

Many existing storage basket structures in the market are assembled by splicing. The storage basket structures each usually include an upper frame, a lower frame, support rods and a fabric sleeve, where the upper frame is connected to the lower frame by the support rods, and the fabric sleeve is cylindrical. Openings at both ends of the fabric sleeve are sleeved on the upper frame and the lower frame respectively, and the fabric sleeve is propped up by the upper frame, the lower frame and the support rods, and is equivalent to a shell of a storage basket.

However, after the assembly of the storage basket structure is completed, the fabric sleeve is in a loose state, which leads to a poor appearance of the storage basket structure and poor user experience.

SUMMARY

An embodiment of the present invention provides a storage basket structure, which aims to solve the problem that a fabric sleeve is in a loose state after assembly of an existing storage basket structure is completed, which affects an appearance.

The embodiment of the present invention is implemented in this way: A storage basket structure is provided, including:

support rods;

a top plate connected to a first end of each support rod;

a base movably connected to a second end of the support rod;

a fabric sleeve, where the fabric sleeve is cylindrical and includes a first end opening and a second end opening, the first end opening is connected to the top plate, and the second end opening is connected to the base; and an adjusting device arranged on the base, where the adjusting device is in contact with the second end of the support rod, to adjust a distance between the top plate and the base.

Further, the base is provided with a mounting hole, the second end of the support rod is movably arranged in the mounting hole, the adjusting device includes a nut and a screw, the nut is arranged in the mounting hole, and the screw abuts against the second end of the support rod.

Further, the support rod is a hollow pipe, the second end of the support rod is provided with a first pipe plug, and the screw is in contact with the first pipe plug.

Further, the top plate is provided with a first accommodating groove, the base is provided with a second accommodating groove, the first end opening is embedded in the first accommodating groove, and the second end opening is embedded in the second accommodating groove.

Further, the first end opening and/or the second end opening is provided with a hard film.

Further, the storage basket structure further includes a top cover and a hinge assembly, where the top cover is hinged to the top plate through the hinge assembly.

Further, the hinge assembly includes a first hinge portion, a second hinge portion and a pin, where the first hinge portion is connected to the top cover;

the second hinge portion is hinged to the first hinge portion through the pin; and the top plate is provided with an insertion groove matching the second hinge portion.

Further, the second hinge portion is provided with an elastic claw, and the elastic claw is configured to cooperate with and be detachably connected to an edge of the insertion groove.

Further, the storage basket structure further includes a bottom rubber plug, where a bottom of the base is provided with a mounting groove matching the bottom rubber plug.

In a second aspect, the present application further provides a laundry basket, including:

an inner bag; and the storage basket structure as described above, where a top plate of the storage basket structure is provided with an opening, and the inner bag is detachably mounted at the opening of the top plate to contain clothes.

Further, an edge of the opening of the top plate is a first inclined surface, an opening of the inner bag is provided with a hanging ring, and the hanging ring has a second inclined surface matching the first inclined surface.

The present application has the beneficial effects that the storage basket structure according to the present application includes support rods; a top plate connected to a first end of each support rod; a base movably connected to a second end of the support rod; a fabric sleeve, which is cylindrical and includes a first end opening and a second end opening, where the first end opening is connected to the top plate, and the second end opening is connected to the base; and an adjusting device arranged on the base, where the adjusting device is in contact with the second end of the support rod, to adjust a distance between the top plate and the base. The support rod is lifted by the adjusting device, so as to adjust the distance between the top plate and the base. Since the first end opening and the second end opening of the fabric sleeve are connected to the top plate and the base respectively, the fabric sleeve can be better tightened by increasing the distance between the top plate and the base, thereby achieving a better appearance, presenting a premium feel to users and bringing good user experience.

BRIEF DESCRIPTION OF DRA WINGS

Figure 1:
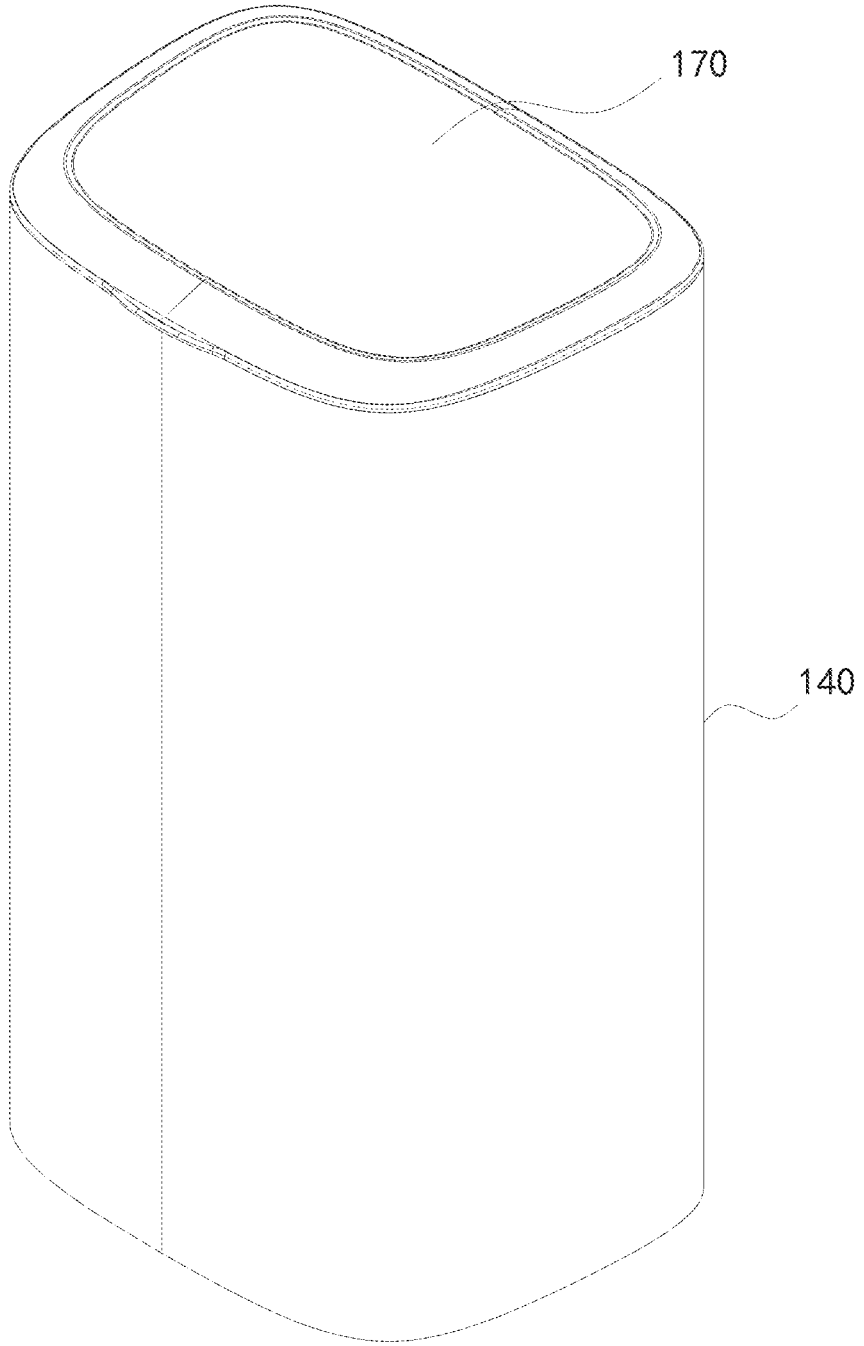
FIG. 1 is a schematic structural diagram of a storage basket structure according to an embodiment of the present application.
Figure 2:
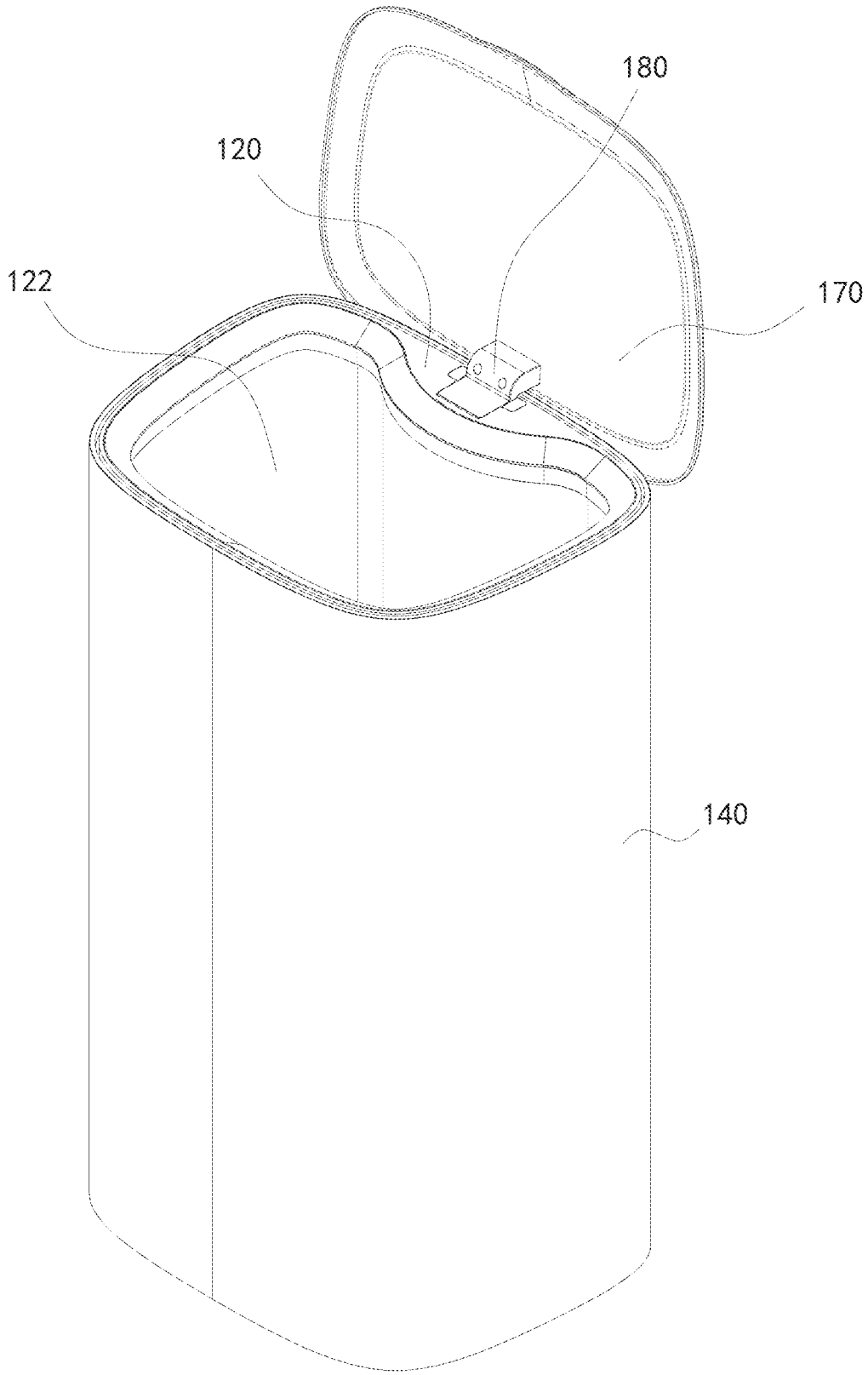
FIG. 2 is a schematic structural diagram of a storage basket structure with a top cover being opened according to an embodiment of the present application.
Figure 3:
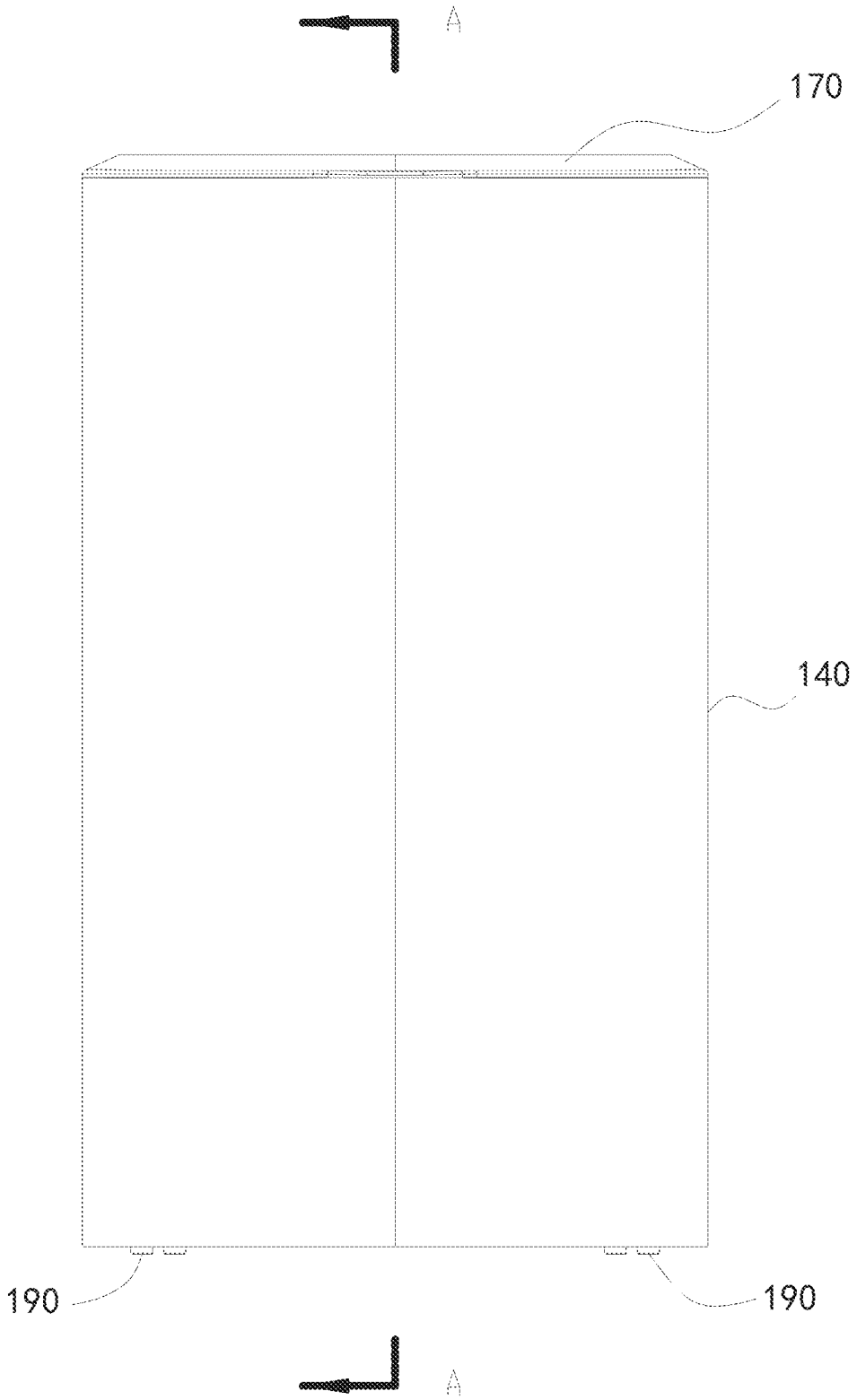
FIG. 3 is a schematic front view of a storage basket structure according to an embodiment of the present application.
Figure 4:
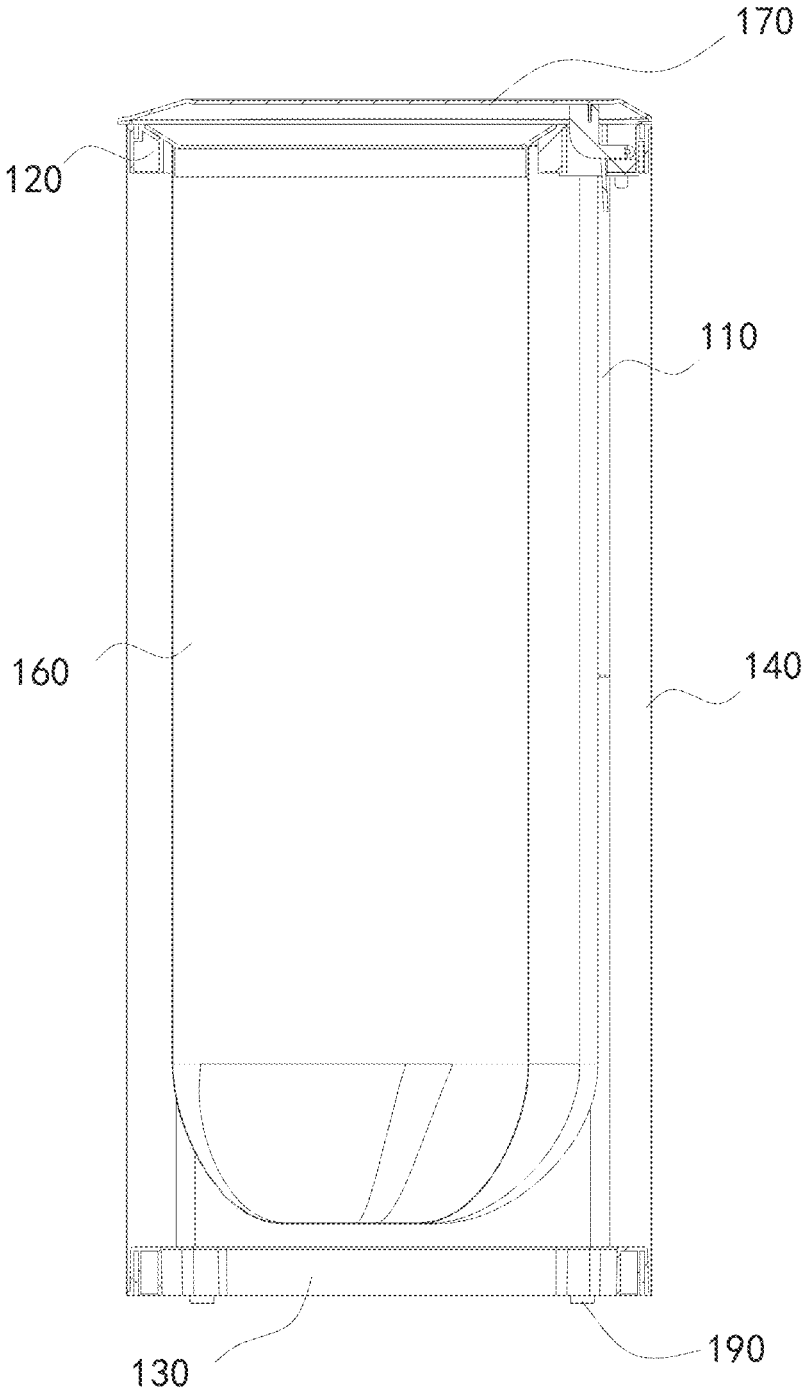
FIG. 4 is a schematic sectional view taken along line A-A of FIG. 3.
Figure 5:
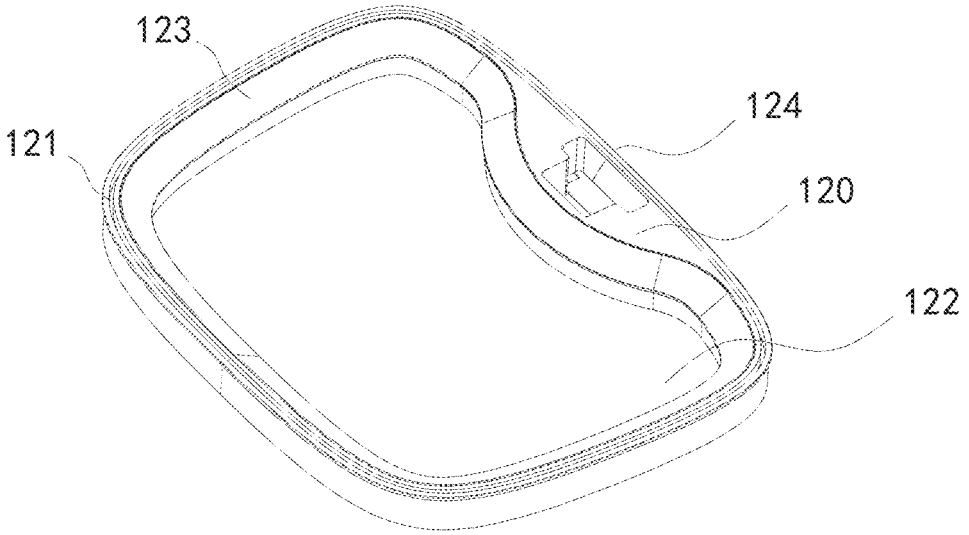
FIG. 5 is a schematic structural diagram of a top plate of a storage basket structure according to an embodiment of the present application.
Figure 6:
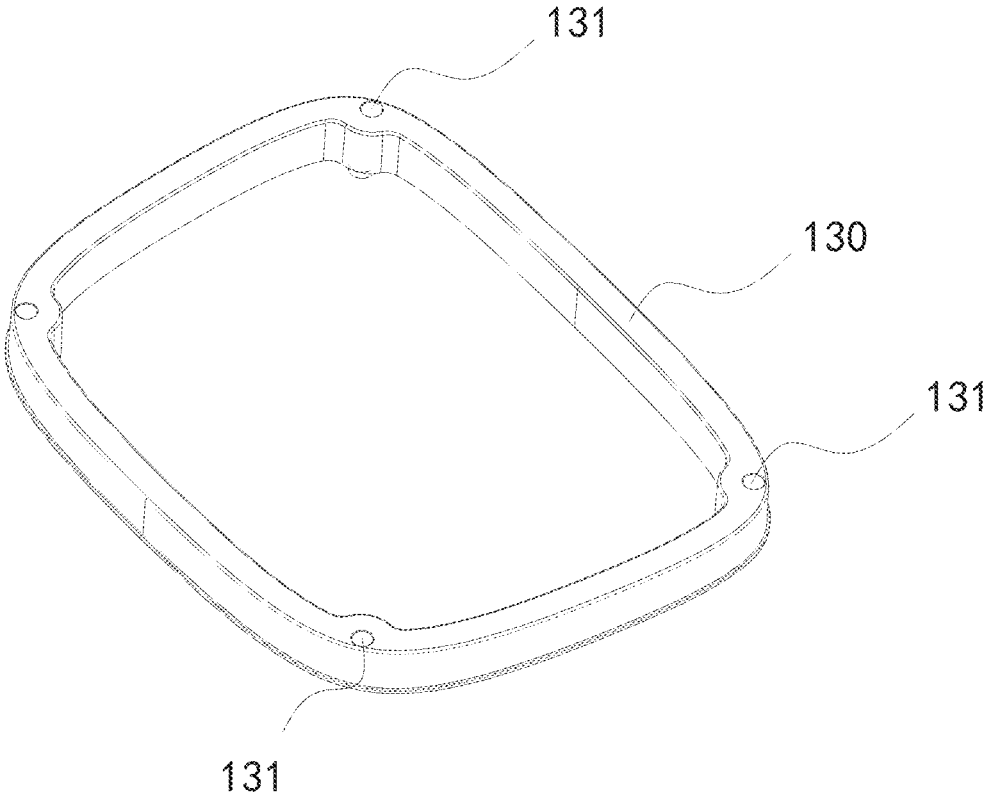
FIG. 6 is a schematic structural diagram of a base of a storage basket structure according to an embodiment of the present application.
Figure 7:
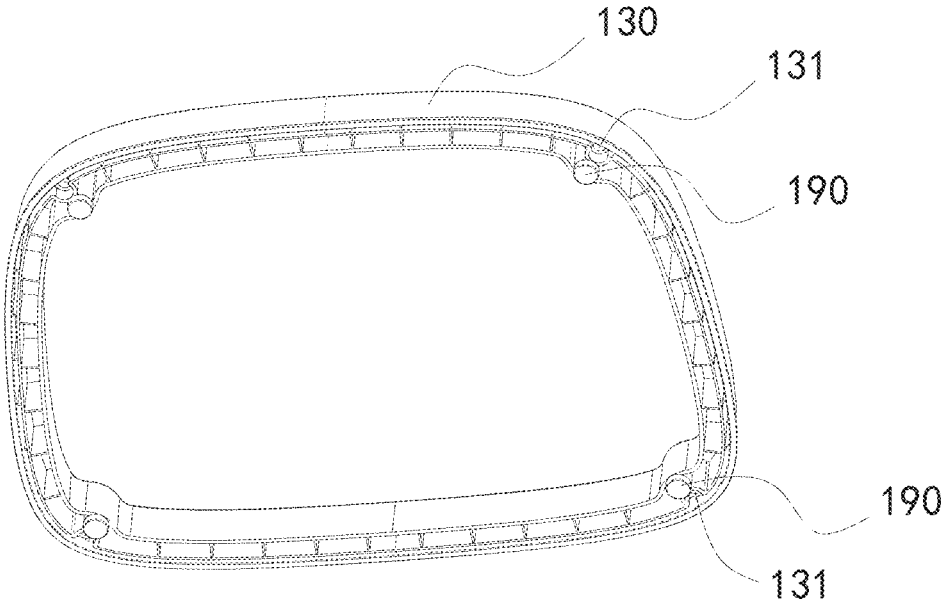
FIG. 7 is a schematic structural diagram of a base of a storage basket structure according to an embodiment of the present application.
Figure 8:
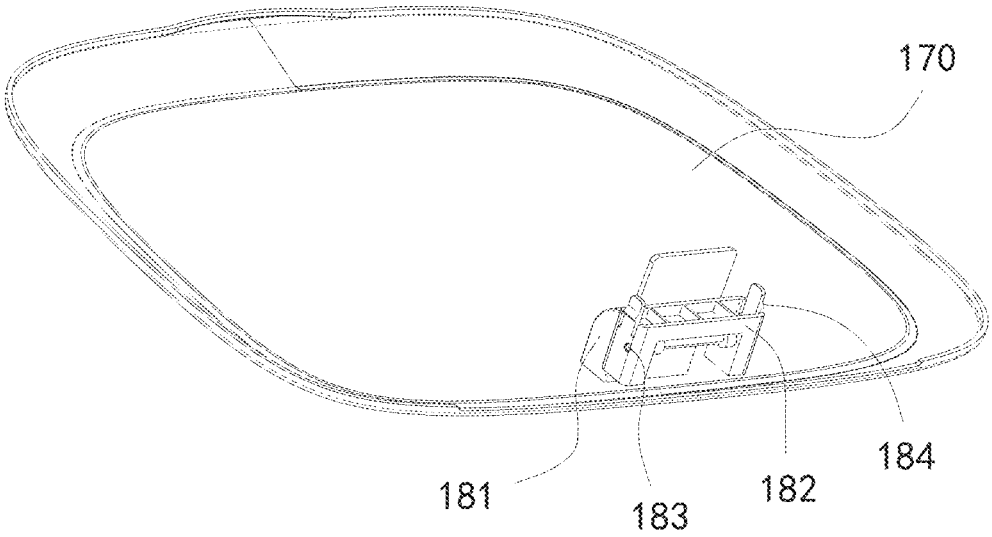
FIG. 8 is a schematic structural diagram of a top cover of a storage basket structure according to an embodiment of the present application.

Description of reference signs: 110—Support rod, 111—First pipe plug, 120—Top plate, 121—First accommodating groove, 122—Opening, 123—First inclined surface, 124—Insertion groove, 130—Base, 131—Mounting hole, 132—Second accommodating groove, 140—Fabric sleeve, 150—Adjusting device, 151—Nut, 152—Screw, 160—Inner bag, 161—Hanging ring, 162—Second inclined surface, 170—Top cover, 180—Hinge assembly, 181—First hinge portion, 182—Second hinge portion, 183—Pin, 184—Elastic claw, 190—Bottom rubber plug.

DESCRIPTION OF EMBODIMENTS

To make the objective, technical solutions and advantages of the present invention clearer, the present invention is described in further detail below with reference to the accompanying drawings and embodiments. Examples of the embodiments are shown in the accompanying drawings. The same or similar reference signs represent the same or similar elements or elements having the same or similar functions throughout. The embodiments described below with reference to the accompanying drawings are for example, are used only for explaining the present invention, and should not be construed as a limitation to the present invention. In addition, it should be understood that specific embodiments described herein are merely used to explain the present invention, but are not intended to limit the present invention.

In the description of the present invention, it should be understood that the orientations or positional relationships indicated by the terms "length", "width", "upper", "lower", "left", "right", "horizontal", "top", "bottom", and the like are based on the orientations or positional relationships shown in the accompanying drawings, and are only for the convenience of describing the present invention and simplifying the description, rather than indicating or implying that the device or element referred to must have a specific orientation or be constructed and operated in a specific orientation, and therefore cannot be construed as limiting the present invention.

In addition, the terms "first" and "second" are used for descriptive purposes only, and cannot be construed as indicating or implying relative importance or implicitly indicating the number of technical features indicated. Thus, the features defined with "first" and "second" may explicitly or implicitly include one or more of the features. In the description of the present invention, "a plurality of" means two or more, unless otherwise explicitly and specifically defined.

In the description of the present invention, it should be noted that, unless otherwise specified and limited, the terms "mount", "connection" and "connect" should be understood in a broad sense, for example, may be a fixed connection, a detachable connection, or an integral connection; may be a mechanical connection, an electrical connection, or communication with each other; and may be a direct connection, an indirect connected connection by an intermediate medium, or an internal connection between two elements or an interaction relationship between the two elements. For a person of ordinary skill in the art, specific meanings of the above terms in the present invention may be understood according to specific circumstances.

In the present invention, unless otherwise specified and limited, that a first feature is "above" or "below" a second feature may include that the first feature is in direct contact with the second feature, or that the first feature and the second feature are not in direct contact, but in contact by using another feature therebetween. In addition, that the first feature is "above" the second feature includes that the first feature is over or obliquely above the second feature, or only indicates that the first feature has a horizontal height greater than that of the second feature. The first feature being "below", "under" or "beneath" the second feature includes the case that the first feature is directly or obliquely below the second feature, or merely indicates that the first feature is at a lower level than the second feature.

The following disclosure provides many different embodiments or examples to implement different structures of the present invention. To simplify the disclosure of the present invention, the components and arrangements of specific examples are described below. Certainly, these are only examples and are not intended to limit the present invention. In addition, in the present invention, reference numerical values and/or reference letters may be repeated in different examples. This repetition is for the sake of simplicity and clarity, and does not itself indicate the relationship between the various embodiments and/or arrangements discussed. In addition, the present invention provides examples of various specific processes and materials, but a person of ordinary skill in the art may be aware of the application of other processes and/or the use of other materials.

A storage basket structure according to the present application includes support rods; a top plate connected to a first end of each support rod; a base movably connected to a second end of the support rod; a fabric sleeve, which is cylindrical and includes a first end opening and a second end opening, where the first end opening is connected to the top plate, and the second end opening is connected to the base; and an adjusting device arranged on the base, where the adjusting device is in contact with the second end of the support rod, to adjust a distance between the top plate and the base. The support rod is lifted by the adjusting device, so as to adjust the distance between the top plate and the base. Since the first end opening and the second end opening of the fabric sleeve are connected to the top plate and the base respectively, the fabric sleeve can be better tightened by increasing the distance between the top plate and the base, thereby achieving a better appearance, presenting a premium feel to users and bringing good user experience.

As shown in FIG. 1 to FIG. 11, an embodiment of the present application provides a storage basket structure, including:

support rods 110;

a top plate 120 connected to a first end of each support rod 110;

a base 130 movably connected to a second end of the support rod 110;

a fabric sleeve 140, where the fabric sleeve 140 is cylindrical and includes a first end opening 122 and a second end opening 122, the first end opening 122 is connected to the top plate 120, and the second end opening 122 is connected to the base 130; and an adjusting device 150 arranged on the base 130, where the adjusting device 150 is in contact with the second end of the support rod 110, to adjust a distance between the top plate 120 and the base 130.

The storage basket structure is used to store clothes that need to be changed and washed, maintain cleanliness and hygiene, or help to tidy furniture for storing toys. The storage basket structure has a support. The support includes an upper frame, a lower frame and support rods 110. The upper frame is connected to the lower frame through the support rods 110. That is, the upper frame, the lower frame and the support rods 110 form a skeleton of the storage basket structure.

Optionally, the top plate 120 is provided with a mounting hole 131, and the first end of the support rod 110 may be inserted into the mounting hole 131 to mount and fix the support rod 110 to the top plate 120.

The fabric sleeve 140 refers to a fabric, including but not limited to cotton, polyester cotton or a nylon material, and for example, the fabric sleeve 140 may be made of an Oxford fabric, which is not limited.

The openings 122 are formed at both ends of the fabric sleeve 140, so that the fabric sleeve can be sleeved on the upper frame and the lower frame. Because the support rod 110 is movably connected to the base 130, relative positions of the support rod 110 and the base 130 can be adjusted by the adjusting device 150, and then the distance between the top plate 120 and the base 130 can be adjusted.

For example, taking the adjusting device 150 being a latch as an example, the base 130 is provided with a mounting hole 131 for inserting the second end of the support rod 110, and the second end of the support rod 110 may move freely in the mounting hole 131 of the base 130. A side wall of the mounting hole 131 is provided with a plurality of through holes distributed along an axis, and a portion of the support rod 110 close to the second end thereof is also provided with a plurality of holes. The latch passes through one through hole of the base 130 and one hole of the support rod 110, to mount and fix the support rod 110 to the base 130. Since both ends of the fabric sleeve 140 are sleeved on the upper frame and the lower frame respectively, the fabric sleeve 140 is loose.

During adjustment, the latch is taken out, then the base 130 and the support rod 110 are adjusted to required positions, and then the latch is inserted into one through hole of the base 130 and one hole of the support rod 110 again, so that the support rod 110 is mounted and fixed to the base 130, and the fabric sleeve 140 is tightened by increasing the distance between the base 130 and the top plate 120.

Optionally, the second end of the support rod 110 is movable arranged in the mounting hole 131, and the adjusting device 150 includes a nut 151 and a screw 152. The nut 151 is arranged in the mounting hole 131, and the screw 152 abuts against the second end of the support rod 110. Through cooperation of the screw 152 and the nut 151, an adjustment function between the support rod 110 and the base 130 is achieved. For example, taking an example in which a storage basket is placed on a horizontal surface, the top plate 120 is arranged above the base 130. The screw 152 is screwed into the nut 151 from bottom to top, and the screw 152 abuts against the second end of the support rod 110. When the screw 152 is unscrewed, for example, when the screw 152 is rotated counterclockwise, the support rod 110 is further embedded in the mounting hole 131, so that the distance between the base 130 and the top plate 120 can be shortened. Similarly, when the screw 152 is screwed in, for example, when the screw 152 is rotated clockwise, the screw 152 lifts the support rod 110, so that the portion of the support rod 110 close to the second end thereof moves out of the mounting hole 131, which can increase the distance between the base 130 and the top plate 120.

Optionally, the adjusting device 150 may alternatively use another device or structure. For example, the base 130 is provided with a threaded hole, and the second end of the support rod 110 is provided with an external thread matching the threaded hole, so that relative positions of the support rod 110 and the base 130 are adjusted by rotating the support rod 110, so as to adjust the distance between the base 130 and the top plate 120, which is not specifically limited.

It should be noted that the above-mentioned storage basket structure is used to store clothes or toys, which is an illustration of the embodiment of the present application, but not a specific limitation on the present application. In some other embodiments, the storage basket structure may also be used to store other articles, such as books, newspapers, magazines and other sundries, which is not specifically limited.

A storage basket structure according to the present application includes support rods 110; a top plate 120 connected to a first end of each support rod 110; a base 130 movably connected to a second end of the support rod 110; a fabric sleeve 140, which is cylindrical and includes a first end opening 122 and a second end opening 122, where the first end opening 122 is connected to the top plate 120, and the second end opening 122 is connected to the base 130; and an adjusting device 150 arranged on the base 130, where the adjusting device 150 is in contact with the second end of the support rod 110, to adjust a distance between the top plate 120 and the base 130. The support rod 110 is lifted by the adjusting device 150, so as to adjust the distance between the top plate 120 and the base 130. Since the first end opening 122 and the second end opening 122 of the fabric sleeve 140 are connected to the top plate 120 and the base 130 respectively, the fabric sleeve 140 can be better tightened by increasing the distance between the top plate 120 and the base 130, thereby achieving a better appearance, presenting a premium feel to users and bringing good user experience.

Figure 13:
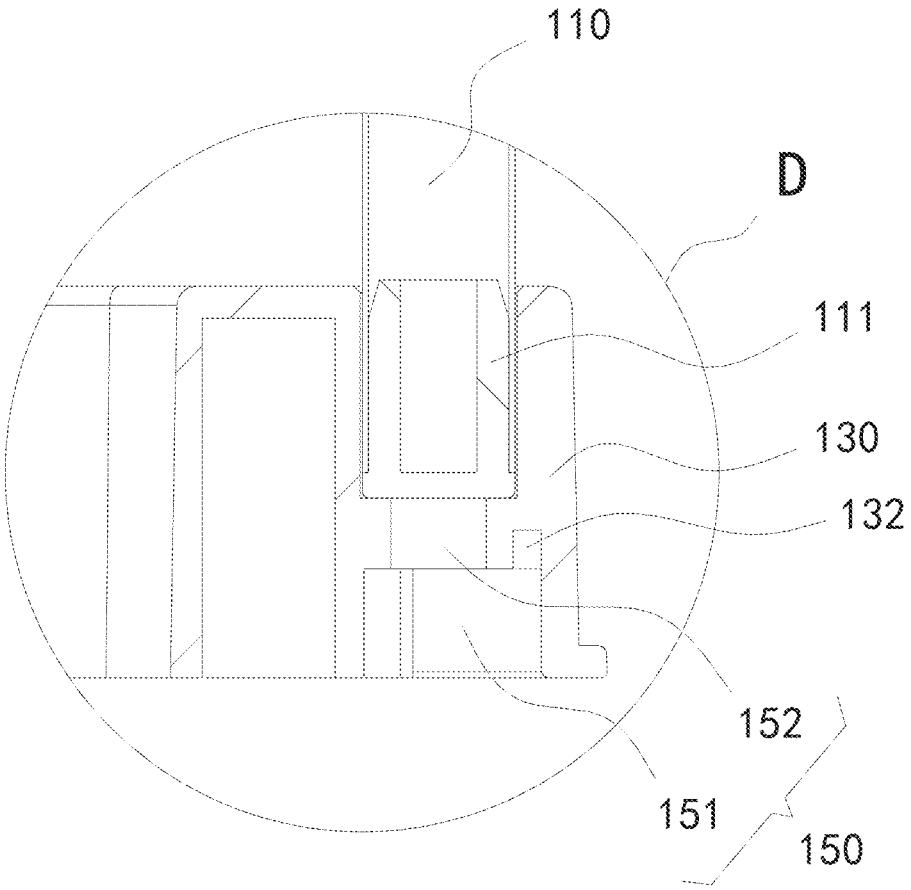
FIG. 13 is an enlarged schematic diagram of a part D of FIG. 11.

In some optional embodiments, the support rod 110 may be a hollow pipe, the second end of the support rod 110 is provided with a first pipe plug 111, and the screw 152 is in contact with the first pipe plug 111, as shown in FIG. 13. By designing the support rod 110 as a hollow pipe, the amount of the support rod 110 used can be reduced, the weight can be reduced, and costs can be controlled.

Figure 12:
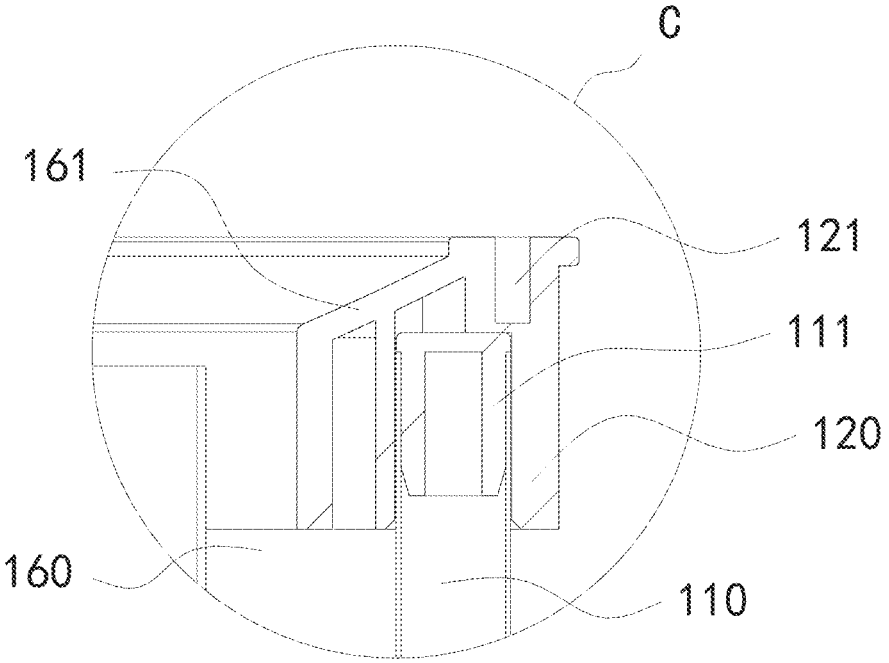
FIG. 12 is an enlarged schematic diagram of a part C of FIG. 11.

Optionally, the first end of the support rod 110 may be also provided with a first pipe plug 111, so that a contact area between the support rod 110 and the top plate 120 is increased by the first pipe plug 111 to ensure product quality, as shown in FIG. 12.

Optionally, the first pipe plug 111 may be made of a hard material, such as iron, copper, aluminum or hard plastic, which is not limited.

Optionally, the first pipe plug 111 may alternatively be made of a soft material, such as a silica gel, a rubber or flexible plastic, which is not limited.

In some embodiments, the top plate 120 is provided with a first accommodating groove 121, the base 130 is provided with a second accommodating groove 132, the first end opening 122 is embedded in the first accommodating groove 121, and the second end opening 122 is embedded in the second accommodating groove 132.

During the implementation, the first accommodating groove 121 and the second accommodating groove 132 are both annular grooves, so that the openings 122 at both ends of the fabric sleeve 140 can be embedded in the corresponding accommodating grooves, so that the mounting of the fabric sleeve 140 to the top plate 120 and the mounting of the fabric sleeve 140 to the base 130 are completed.

Optionally, the first end opening 122 and/or the second end opening 122 is provided with a hard film. With the arrangement of the hard film, the openings 122 of the fabric sleeve 140 can be embedded in the accommodating grooves more conveniently, thereby implementing simple and convenient mounting.

Further, the storage basket structure according to the present application further includes a top cover 170 and a hinge assembly 180, where the top cover 170 is hinged to the top plate 120 through the hinge assembly 180. The top cover 170 is hinged to the top plate 120, so that articles can be placed in the inner bag 160 when the top cover 170 is opened, or space in the storage basket structure can be closed when the top cover 170 is closed, so as to prevent dust or water from falling or splashing into the inner bag 160.

Further, the hinge assembly 180 includes a first hinge portion 181, a second hinge portion 182 and a pin 183, where the first hinge portion 181 is connected to the top cover 170;

the second hinge portion 182 is hinged to the first hinge portion 181 through the pin 183; and the top plate 120 is provided with an insertion groove 124 matching the second hinge portion 182.

The first hinge portion 181 is hinged to the second hinge portion 182 through the pin 183, and the second hinge portion 182 may be inserted into the insertion groove 124, to mount and connect the second hinge portion 182 to the top plate 120, thereby implementing the hinging of the top cover 170 to the top plate 120, and implementing convenient assembly.

Figure 10:
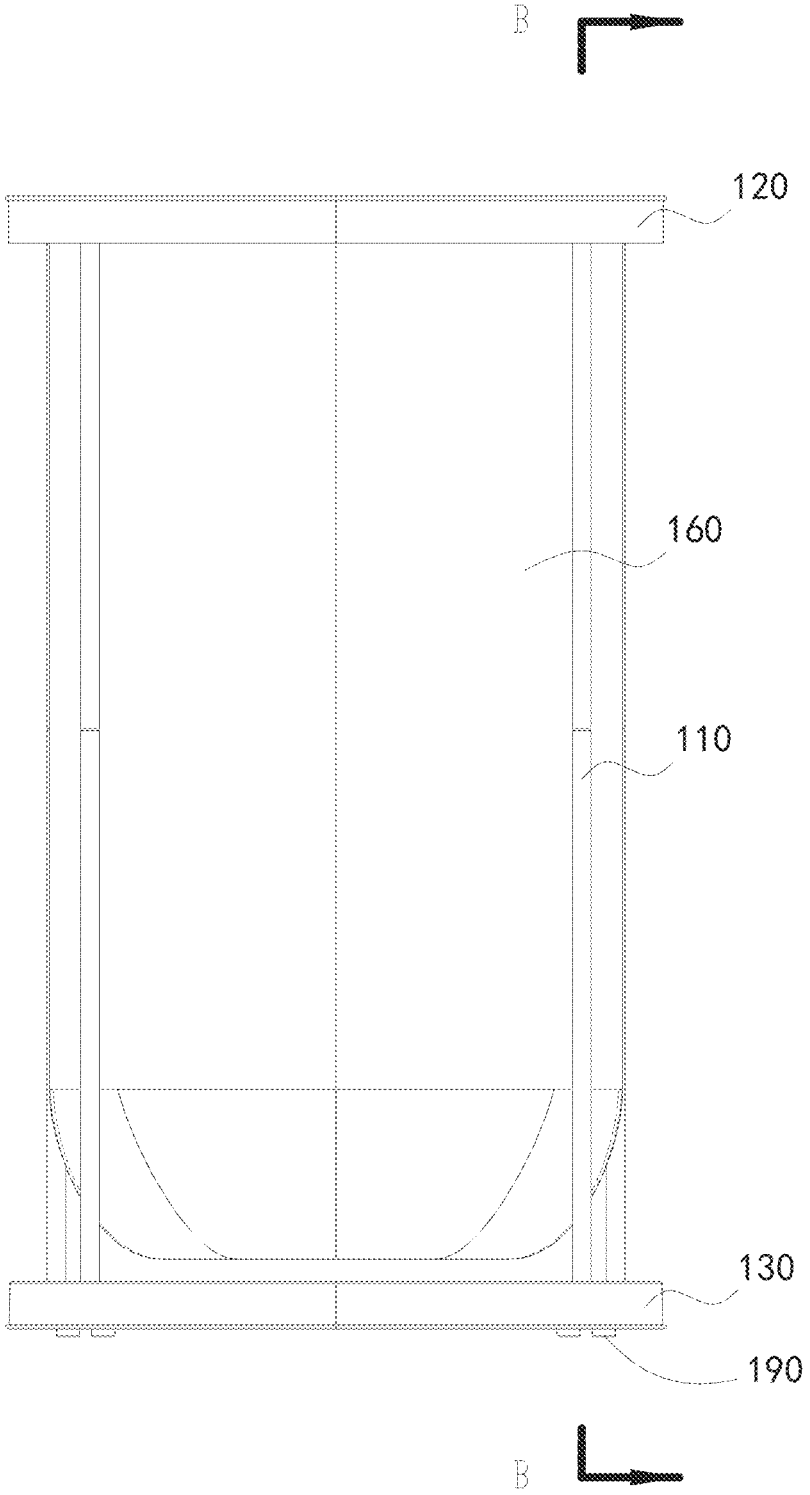
FIG. 10 is a schematic front view of an internal structure of a laundry basket according to an embodiment of the present application.
Figure 11:
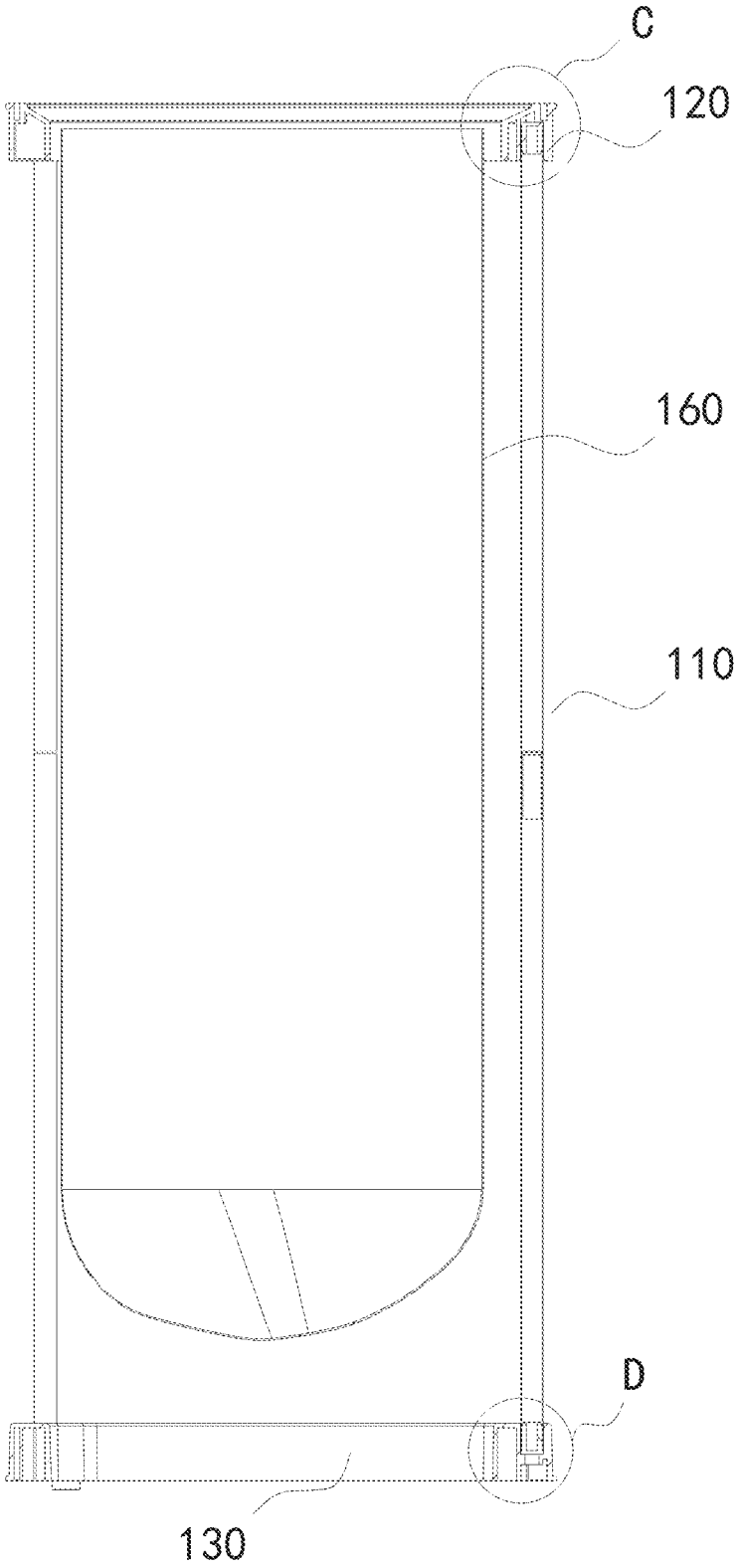
FIG. 11 is a schematic sectional view taken along line B-B of FIG. 10.

Optionally, the second hinge portion 182 is provided with an elastic claw 184, and the elastic claw 184 is configured to cooperate with and be detachably connected to an edge of the insertion groove 124, thereby implementing convenient and reliable assembly, as shown in FIG. 10.

Further, the storage basket structure according to the present application further includes a bottom rubber plug 190, where a bottom of the base 130 is provided with a mounting groove matching the bottom rubber plug 190.

The bottom rubber plug 190 may be made of the above-mentioned flexible material, which is not limited. With the arrangement of the bottom rubber plug 190, the storage basket can be placed more stably and reliably.

In some embodiments, the present application further provides a laundry basket, including:

an inner bag 160; and the storage basket structure as described above.

For the storage basket structure, reference may be made to the structure and principle in the above embodiments, and details are not described. A top plate 120 of the storage basket structure is provided with an opening 122, and the inner bag 160 is detachably mounted at the opening 122 of the top plate 120 to contain clothes.

During the implementation, the inner bag 160 is a cloth bag with a single opening 122. The inner bag 160 may be mounted at the opening 122 of the top plate 120, so that articles such as dirty clothes can be conveniently put into the inner bag 160, and the inner bag 160 may be removed, to pour out the articles in the inner bag 160, thereby implementing convenient use.

Figure 9:
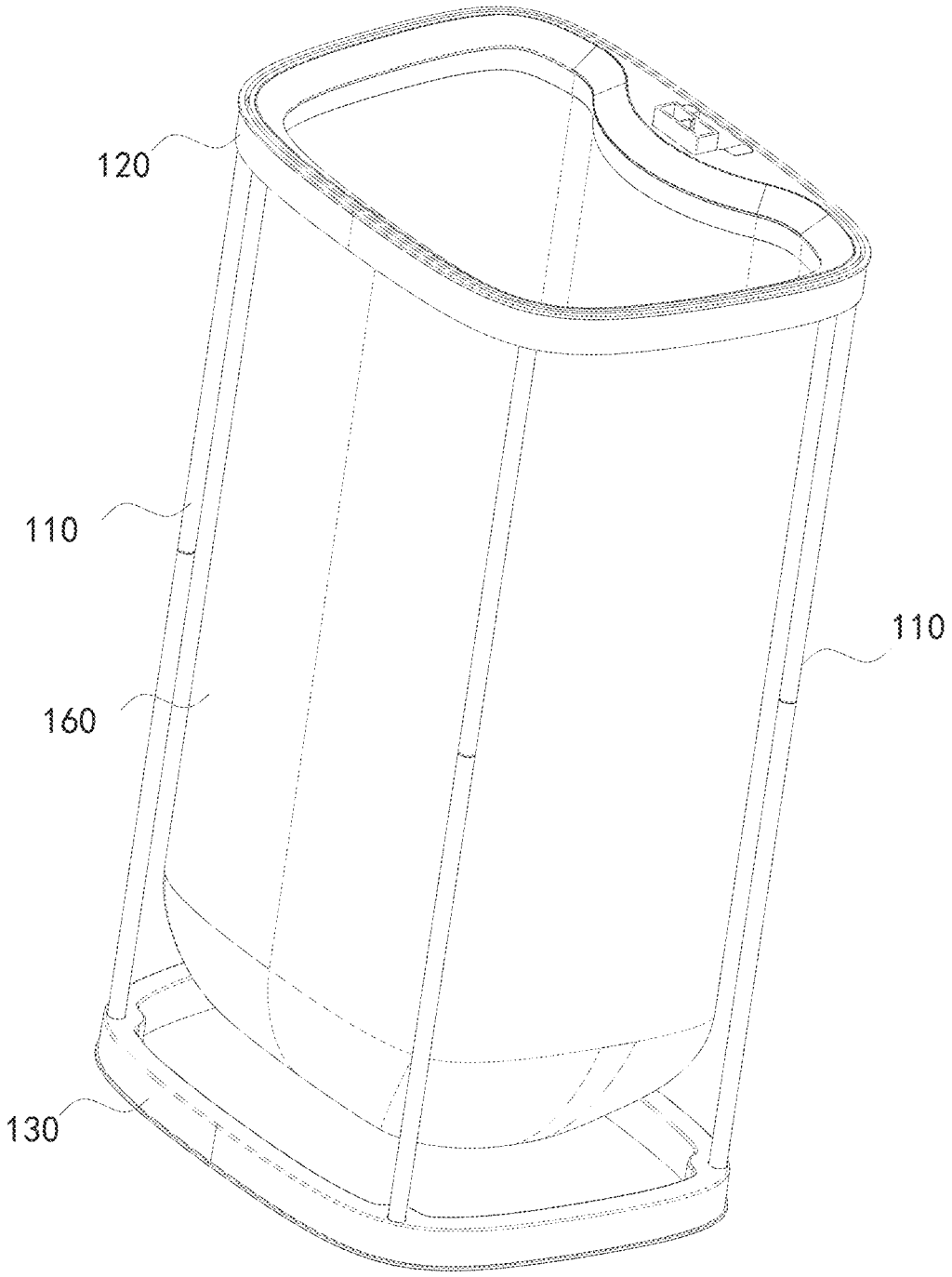
FIG. 9 is a schematic diagram of an internal structure of a laundry basket according to an embodiment of the present application.
Figure 14:
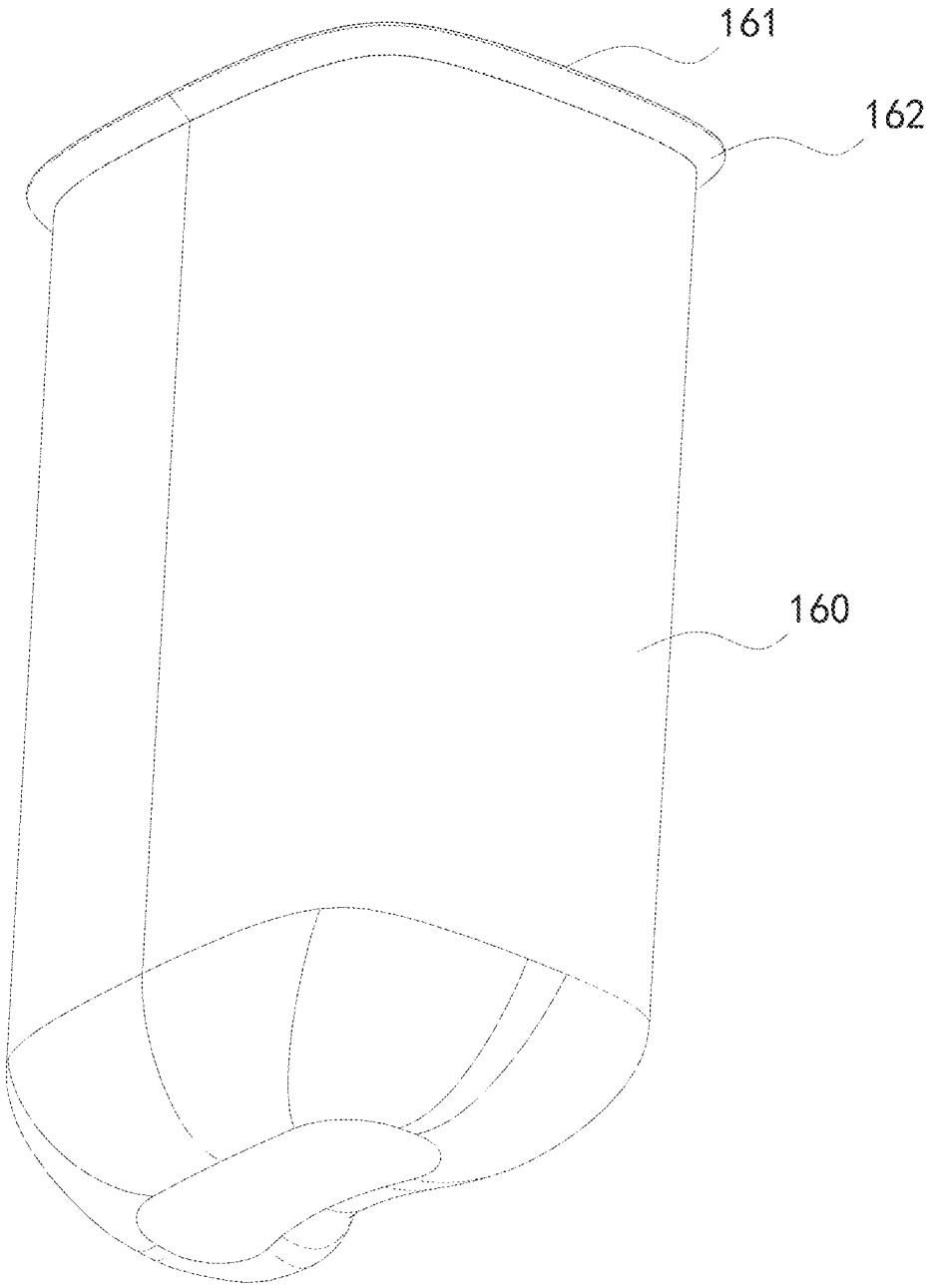
FIG. 14 is a schematic structural diagram of an inner bag of a laundry basket according to an embodiment of the present application.

Further, an edge of the opening 122 of the top plate 120 is a first inclined surface 123, the opening 122 of the inner bag 160 is provided with a hanging ring 161, and the hanging ring 161 has a second inclined surface 162 matching the first inclined surface 123. Through the matching of the first inclined surface 123 and the second inclined surface 162, the inner bag 160 can be more conveniently placed and mounted at the opening 122 of the top plate 120, as shown in FIG. 9, FIG. 10, and FIG. 14.

A storage basket structure according to the present application includes support rods 110; a top plate 120 connected to a first end of each support rod 110; a base 130 movably connected to a second end of the support rod 110; a fabric sleeve 140, which is cylindrical and includes a first end opening 122 and a second end opening 122, where the first end opening 122 is connected to the top plate 120, and the second end opening 122 is connected to the base 130; and an adjusting device 150 arranged on the base 130, where the adjusting device 150 is in contact with the second end of the support rod 110, to adjust a distance between the top plate 120 and the base 130. The support rod 110 is lifted by the adjusting device 150, so as to adjust the distance between the top plate 120 and the base 130. Since the first end opening 122 and the second end opening 122 of the fabric sleeve 140 are connected to the top plate 120 and the base 130 respectively, the fabric sleeve 140 can be better tightened by increasing the distance between the top plate 120 and the base 130, thereby achieving a better appearance, presenting a premium feel to users and bringing good user experience.

The above descriptions are merely preferred embodiments of the present invention, and are not intended to limit the present invention. Any modification, equivalent substitution, improvement, and the like performed within the spirit and principle of the present invention should fall within the protection scope of the present invention.

What is claimed is:

1. A storage basket structure, comprising:

support rods;

a top plate connected to a first end of each support rod;

a base movably connected to a second end of each support rod;

a fabric sleeve, wherein the fabric sleeve is cylindrical and comprises a first end opening and a second end opening, the first end opening is connected to the top plate, and the second end opening is connected to the base; and an adjusting device arranged on the base, wherein the adjusting device is in contact with the second end of each support rod, to adjust a distance between the top plate and the base;

the storage basket structure further comprising a top cover and a hinge assembly, wherein the top cover is hinged to the top plate through the hinge assembly.

2. The storage basket structure according to claim 1, wherein the hinge assembly comprises a first hinge portion, a second hinge portion and a pin, wherein the first hinge portion is connected to the top cover;

the second hinge portion is hinged to the first hinge portion through the pin; and the top plate is provided with an insertion groove receiving the second hinge portion.

3. The storage basket structure according to claim 2, wherein the second hinge portion is provided with an elastic claw, and the elastic claw is configured to cooperate with and be detachably connected to an edge of the insertion groove.

4. A laundry basket comprising the storage basket structure according to claim 3, the laundry basket comprising:

an inner bag; and wherein the top plate of the storage basket structure is provided with an opening, and the inner bag is detachably mounted at the opening of the top plate to contain clothes.

5. A laundry basket comprising the storage basket structure according to claim 2, the laundry basket comprising:

an inner bag; and wherein the top plate of the storage basket structure is provided with an opening, and the inner bag is detachably mounted at the opening of the top plate to contain clothes.

6. The storage basket structure according to claim 1, further comprising a bottom rubber plug, wherein a bottom of the base is provided with a mounting groove matching the bottom rubber plug.

7. A laundry basket comprising the storage basket structure according to claim 6, the laundry basket comprising:

an inner bag; and wherein the top plate of the storage basket structure is provided with an opening, and the inner bag is detachably mounted at the opening of the top plate to contain clothes.

8. A laundry basket comprising the storage basket structure according to claim 1, the laundry basket comprising:

an inner bag; and wherein the top plate of the storage basket structure is provided with an opening, and the inner bag is detachably mounted at the opening of the top plate to contain clothes.

9. The laundry basket according to claim 8, wherein an edge of the opening of the top plate is a first inclined surface, an opening of the inner bag is provided with a hanging ring, and the hanging ring has a second inclined surface matching the first inclined surface.

10. A storage basket structure, comprising:

support rods;

a top plate connected to a first end of each support rod;

a base movably connected to a second end of each support rod;

a fabric sleeve, wherein the fabric sleeve is cylindrical and comprises a first end opening and a second end opening, the first end opening is connected to the top plate, and the second end opening is connected to the base; and an adjusting device arranged on the base, wherein the adjusting device is in contact with the second end of each support rod, to adjust a distance between the top plate and the base, wherein the base is provided with mounting holes, the second end of each support rod is movably arranged in the respective mounting hole, the adjusting device comprises a nut and a screw for each support rod, the nut is arranged in the respective mounting hole, and the screw abuts against the second end of the respective support rod.

11. The storage basket structure according to claim 10, wherein each support rod is a hollow pipe, the second end of each support rod is provided with a first pipe plug, and the screw is in contact with the respective first pipe plug.

12. A laundry basket comprising the storage basket structure according to claim 11, the laundry basket comprising:

an inner bag; and wherein the top plate of the storage basket structure is provided with an opening, and the inner bag is detachably mounted at the opening of the top plate to contain clothes.

13. A laundry basket comprising the storage basket structure according to claim 10, the laundry basket comprising:

an inner bag; and wherein the top plate of the storage basket structure is provided with an opening, and the inner bag is detachably mounted at the opening of the top plate to contain clothes.

14. A storage basket structure, comprising:

support rods;

a top plate connected to a first end of each support rod;

a base movably connected to a second end of each support rod;

a fabric sleeve, wherein the fabric sleeve is cylindrical and comprises a first end opening and a second end opening, the first end opening is connected to the top plate, and the second end opening is connected to the base; and an adjusting device arranged on the base, wherein the adjusting device is in contact with the second end of each support rod, to adjust a distance between the top plate and the base, wherein the top plate is provided with a first accommodating groove, the base is provided with a second accommodating groove, the first end opening is embedded in the first accommodating groove, and the second end opening is embedded in the second accommodating groove.

15. A laundry basket comprising the storage basket structure according to claim 14, the laundry basket comprising:

an inner bag; and wherein the top plate of the storage basket structure is provided with an opening, and the inner bag is detachably mounted at the opening of the top plate to contain clothes.

* * * * *